US007140804B2

(12) United States Patent
Gregg

(10) Patent No.: US 7,140,804 B2
(45) Date of Patent: Nov. 28, 2006

(54) CONCRETE STAMPING APPARATUS

(75) Inventor: David Wayne Gregg, Shawnee, KS (US)

(73) Assignee: Rock N Roller, LLC, Oak Grove, MO (US)

( * ) Notice: Subject to any disclaimer, the term of this patent is extended or adjusted under 35 U.S.C. 154(b) by 0 days.

(21) Appl. No.: 10/697,364

(22) Filed: Oct. 30, 2003

(65) Prior Publication Data

US 2004/0265059 A1 Dec. 30, 2004

Related U.S. Application Data

(63) Continuation-in-part of application No. 10/603,340, filed on Jun. 25, 2003.

(51) Int. Cl.
*E01C 23/09* (2006.01)
*E01C 19/43* (2006.01)
*E01C 23/082* (2006.01)

(52) U.S. Cl. ..... 404/93; 404/122; 404/124; 404/129; 404/131; 172/611

(58) Field of Classification Search ..... 404/93, 404/94, 124, 130, 131, 89, 122, 117, 129; 492/13, 19
See application file for complete search history.

(56) References Cited

U.S. PATENT DOCUMENTS 519,919 A * 5/1894 Maurer ..... 404/124
828,575 A * 8/1906 Schilling ..... 172/545
942,892 A * 12/1909 Dunham ..... 404/131
1,038,732 A * 9/1912 Dunham ..... 404/131
1,099,185 A * 6/1914 Loveland ..... 404/124
1,302,275 A * 4/1919 Ashmore et al. ..... 404/124
1,744,272 A 1/1930 LaPiant et al.
1,955,101 A * 4/1934 Sloan ..... 404/113
2,025,703 A * 12/1935 Baily et al. ..... 404/117
3,910,738 A * 10/1975 Chandler et al. ..... 425/162

(Continued)

FOREIGN PATENT DOCUMENTS

FR 86 05863 4/1986

OTHER PUBLICATIONS

Goldblatt's Catalog and Handy Book 1929, pp. 120-121, 1929 (2 Sheets Total).

(Continued)

*Primary Examiner*—Raymond W Addie
(74) *Attorney, Agent, or Firm*—Polsinelli Shalton Welte Suelthaus PC

(57) ABSTRACT

A concrete stamping apparatus includes a roller with a stamp forming its surface, and a receiving portion for rotatably holding the roller. There is also a system for delivering fluid to the roller along its surface, such that it releases easily from the concrete. The receiving portion can be adjustably weighted, such that the roller will stamp the concrete uniformly as the concrete tightens.

84 Claims, 8 Drawing Sheets

U.S. PATENT DOCUMENTS

| | | | | | |
|---|---|---|---|---|---|
| 4,036,126 | A | * | 7/1977 | Gundersen | 100/210 |
| 4,184,787 | A | | 1/1980 | Uebel | |
| 4,614,486 | A | | 9/1986 | Bragagnini | |
| 4,735,567 | A | | 4/1988 | Frakes | |
| 4,776,723 | A | * | 10/1988 | Brimo | 404/89 |
| 4,828,426 | A | | 5/1989 | Hendricks et al. | |
| 5,022,783 | A | * | 6/1991 | Jones | 404/122 |
| 5,033,906 | A | | 7/1991 | Jordan | |
| 5,222,828 | A | * | 6/1993 | Magalski | 404/103 |
| 5,228,799 | A | | 7/1993 | Sondreal | |
| 5,346,448 | A | | 9/1994 | Sollo | |
| 5,480,259 | A | * | 1/1996 | Thrower | 404/117 |
| 5,846,176 | A | * | 12/1998 | Zieger et al. | 492/13 |
| 5,887,846 | A | | 3/1999 | Hupp | |
| 5,896,929 | A | | 4/1999 | Dori | |
| 6,206,611 | B1 | | 3/2001 | Schreck | |
| 6,540,435 | B1 | | 4/2003 | Lizarraga | |
| 6,585,451 | B1 | * | 7/2003 | Wynings | 404/131 |

OTHER PUBLICATIONS

Quick Imprint Systems, Inc. Brochure, 4 pages.
Quick Imprint Systems, Inc. Information sheet entitled: Over 5,000,000 Square Feet Printed in The Past 12 Years, 1 page.
Quick Imprint Systems, Inc. information sheet entitled: Save These Important Color Instructions, 1 page.
Quick Imprint Rollers drawing, 1 page.

* cited by examiner

CONCRETE STAMPING APPARATUS

CROSS-REFERENCES TO RELATED APPLICATIONS

This application is a continuation-in-part of U.S. patent application Ser. No. 10/603,340, entitled: CONCRETE STAMPING APPARATUS, filed on Jun. 25, 2003. U.S. patent application Ser. No. 10/603,340 is incorporated by reference herein.

TECHNICAL FIELD

The present invention is directed to an apparatus for stamping concrete with patterns, textures or both.

BACKGROUND OF THE INVENTION

Concrete is a staple in the construction industry. It is a preferred material because of its costs. Concrete is typically poured in slabs. Typically, the poured concrete slabs are given a broom finish pattern, by merely sweeping over the concrete with a broom or the like and letting it harden and dry.

Other finish patterns can be put into concrete, to create other aesthetically pleasing surfaces. These finish patterns are typically "stamped" into the concrete by placing flat mats with patterns over the concrete, tamping the mats, with rods and the like, into contact with the wet concrete, and removing these flat mats.

This method of using the patterned mats is subject to numerous drawbacks. Initially, the amount of concrete that can be worked on in a day is limited. These amounts are typically about 15 yards per pour, three times a day, resulting in about 45 yards per day. Additionally, the tamping for each 15 yard portion takes time. Should other 15 yard portions be poured in parallel, they be tamped later in time, when the concrete is tightened, resulting in a non-uniform pattern being stamped into adjacent portions. Finally, stamping in this manner requires judgment of an experienced, well trained workperson, to judge when the stamping process will be optimal. This is because this kind of stamping can not be performed when the concrete is too wet or alternately, too "tight" or dry.

SUMMARY OF THE INVENTION

The present invention provides apparatus and methods for stamping large volumes of concrete in short time spans, with stamps, of patterns, textures or both. The resultant stamping is uniform over the entire series of concrete slabs. A single apparatus of the invention can be used on concrete when it is both wet and tightening, eliminating the need for switching stamps and/or machinery to achieve uniform stamping as the concrete is worked at different stages of its tightening. The apparatus is easy to operate and can be operated by concrete workers of all skill levels, eliminating errors associated with human judgment as well as the need for skilled concrete stamping personnel. The apparatus is also such that it does not require the preparation and stamping time, as associated with conventional stamping mats, allowing for more yards of concrete to be poured and subsequently stamped in a workday or work session, than with these contemporary methods and devices.

The present invention provides an apparatus, to which weight can be added, to accommodate stamping during the tightening of the concrete. By adding this weight, a uniform stamping can be achieved, with the resultant, stamp, of patterns, textures, or both being uniform among all of the slabs in a series of poured concrete slabs.

An embodiment of the invention is directed to a stamping apparatus. This stamping apparatus includes a roller, the roller including a surface defined by a stamp; and a receiver portion, for example, a support member, for receiving the roller in a rotatable engagement. The receiver portion is configured for weighting the roller. The stamp can include a pattern, a texture, or combinations of patterns and textures.

Another embodiment is directed to a stamping apparatus including a roller received by a receiver portion, for example, a support member. The roller includes a surface defined by a stamp, and the receiver receives the roller in a rotatable engagement, and includes at least one holder for holding removable weights. The stamp includes a pattern, a texture, or combinations thereof.

Another embodiment is directed to a stamping apparatus. This apparatus includes a roller, the roller including a surface of at least one layer including a stamp therein; and a receiver portion for receiving the roller in a rotatable engagement. This receiver portion also includes at least one holder for holding removable weights. The stamp includes a pattern, a texture, or combinations thereof.

Another embodiment is directed to a method for stamping concrete. This method includes providing a stamping apparatus including a roller, the roller including a surface defined by a stamp; and a receiver portion (e.g., a support member) for receiving the roller in a rotatable engagement, the receiver portion configured for weighting the roller; weighting to the receiver portion in accordance with the tightness of the concrete being worked; and moving the apparatus over the concrete being worked for stamping the concrete in accordance with the stamp. The weighting process can include adding, subtracting or simply not adding any weight to the receiver portion. The stamp includes a pattern, a texture, or combinations thereof.

Another embodiment is directed to a method for making a concrete stamp. This method includes providing a mold for a roller having a substantially cylindrical shaped cavity and an inner wall, the inner wall including an imprint corresponding to a stamp; placing material into contact with the inner wall to form a layer that includes a stamp corresponding to the imprint; and filling at least a substantial portion of the remaining cavity with a filler material to form a body for the roller. The roller can then be released from the mold. The imprint for the stamp can include a pattern, a texture or combinations thereof.

Another embodiment is directed to a stamping apparatus having a roller, including a surface defined by a stamp, a receiver portion for receiving the roller in a rotatable engagement, and a fluid transport system. The fluid transport system includes at least one conduit for providing fluid to the roller along the surface. The fluid facilitates release (separation) of the roller from the concrete, and can be for example, water, oil, a water-based composition, an oil-based composition, a petroleum-based composition, or the like. The at least one conduit is typically a single conduit or line that typically branches into sublines, or alternately a single subline. These sublines are configured for extending at least to the receiver portion for providing fluid to the roller along the surface.

Another embodiment is directed to a stamping apparatus having a roller, the roller including a surface defined by a stamp, a receiver portion for receiving the roller in a rotatable engagement, the receiver portion configured for weighting the roller; and a fluid transport system. This fluid transport system includes at least one conduit for providing fluid to the roller along the surface. The at least one conduit is typically a single conduit or line that typically branches into sublines, or alternately a single subline. These sublines are configured for extending at least to the receiver portion for providing fluid to the roller along the surface.

Another embodiment is directed to a method for stamping concrete. This method includes providing a stamping apparatus having a roller, the roller including a surface defined by a stamp, a receiver portion for receiving the roller in a rotatable engagement, and a fluid transport system, the system including at least one conduit for providing fluid to the roller along the surface. The apparatus is then moved over the concrete being worked for stamping the concrete in accordance with the stamp, and typically when needed, the fluid transport system is activated, releasing fluid onto the surface of the roller.

Another embodiment details a method for stamping concrete, where there is provided a stamping apparatus including a roller, the roller including a surface defined by a stamp, a receiver portion for receiving the roller in a rotatable engagement, the receiver portion configured for weighting the roller, and a fluid transport system, the system including at least one conduit for providing fluid to the roller along the surface. The receiver portion is weighted in accordance with the tightness of the concrete being worked, and the apparatus is moved over the concrete being worked for stamping the concrete in accordance with the stamp. Typically, when needed, the fluid transport system is activated, releasing fluid onto the surface of the roller.

BRIEF DESCRIPTION OF THE DRAWINGS

Attention is now directed to the attached drawings, wherein like reference numerals indicate corresponding or like components. In the drawings.

DETAILED DESCRIPTION OF THE DRAWINGS

Figure 1:
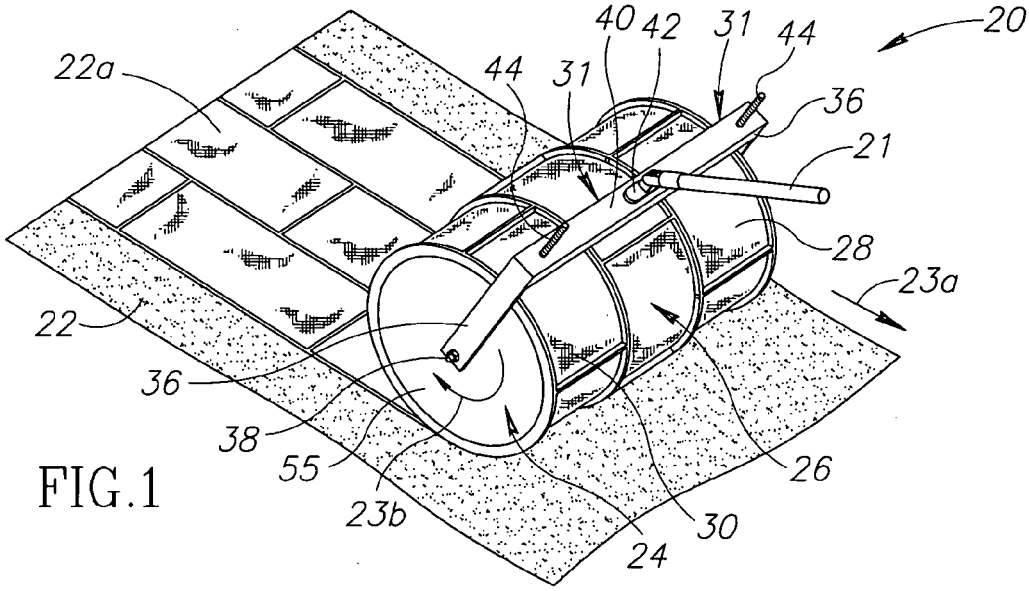
FIG. 1 shows a perspective view of an embodiment of the apparatus of the present invention in use in an exemplary operation also in accordance with the present invention.

FIG. 1 shows the apparatus 20 of the present invention in an exemplary operation. Here, the apparatus 20 is being pulled, as a user (not shown) pulls a handle 21 of the apparatus 20, along a drying (tightening) concrete slab 22 (in the direction of the arrow 23*a*). This movement of the roller 24 causes it to rotate (in the direction of the arrow 23*b*), such that the roller 24, with a stamp or imprint 26 defining its outer surface 28, on a layer 30 of the roller 24, transfers the stamp or imprint 26 to, or "stamps", the concrete 22. Here, a stamp of a pattern and a texture (corresponding to the stamp 26 on the roller 24), for example, that of worn brick, has been stamped into a portion 22*a* of the concrete 22 by the apparatus 20.

Figure 2:
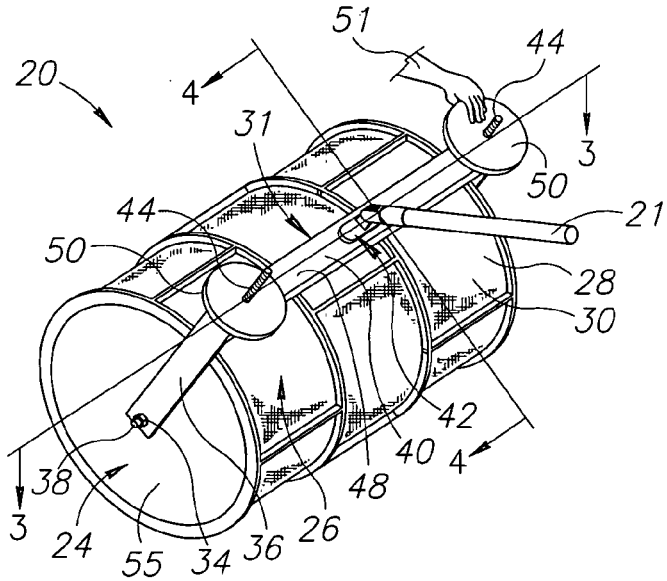
FIG. 2 shows a perspective view of the apparatus of FIG. 1.
Figure 3A:
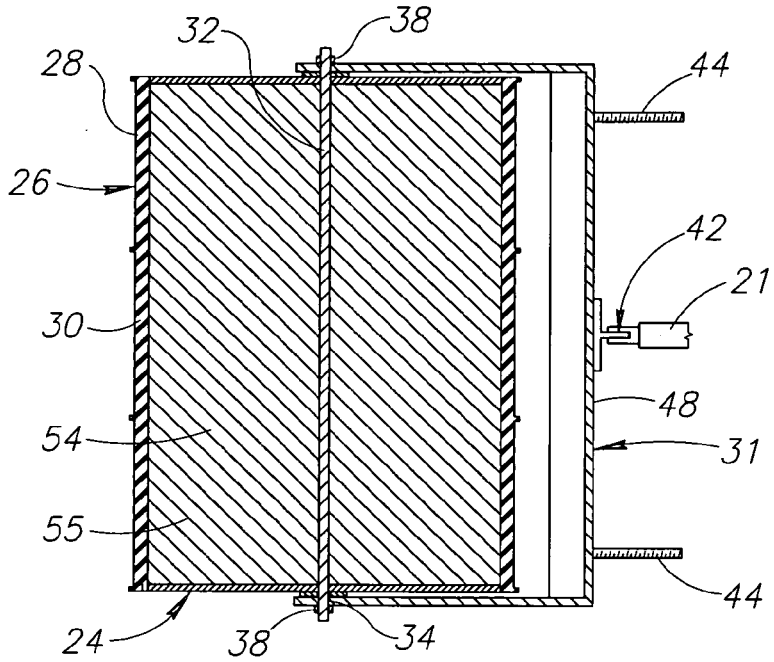
FIG. 3A shows a cross sectional view of the apparatus of FIG. 2, taken along line 3—3 of FIG. 2.

Turning also to FIGS. 2 and 3A, the roller 24 connects to the handle 21 by a support member 31. The roller 24 is rotatably attached to the support member 31 by an axle 32, whose ends are received in openings 34 in lateral members 36 of the support member 31. The axle 32 is maintained in place by bolts 38, caps or the like.

Figure 3B:
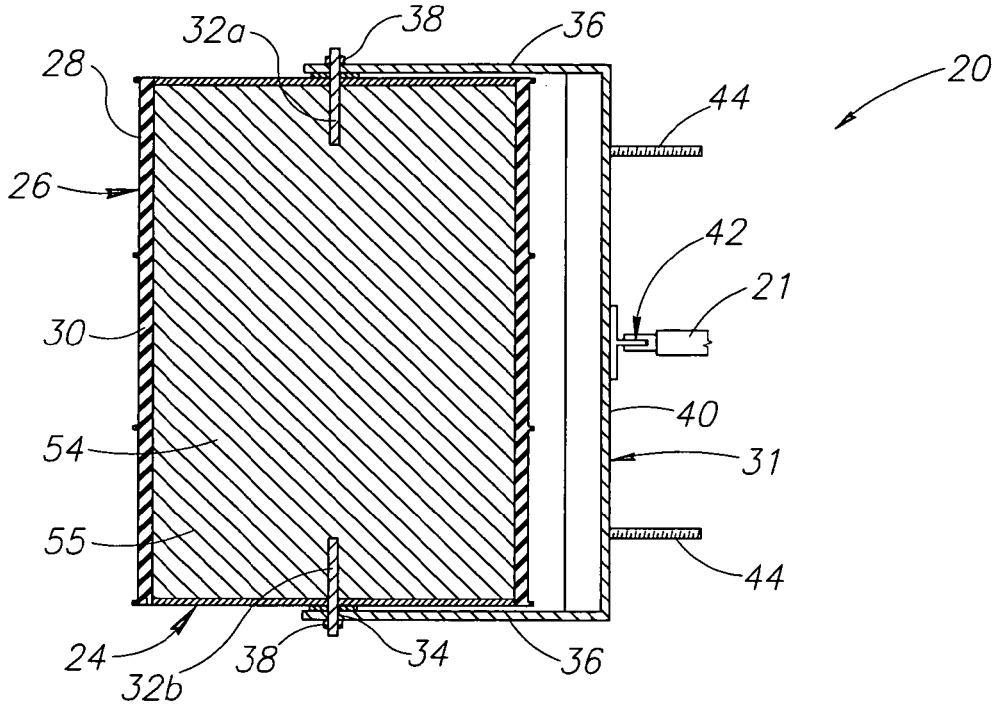
FIG. 3B shows a cross sectional view of an alternate roller for the apparatus of FIG. 2, taken along line 3—3 of FIG. 2.
Figure 4:
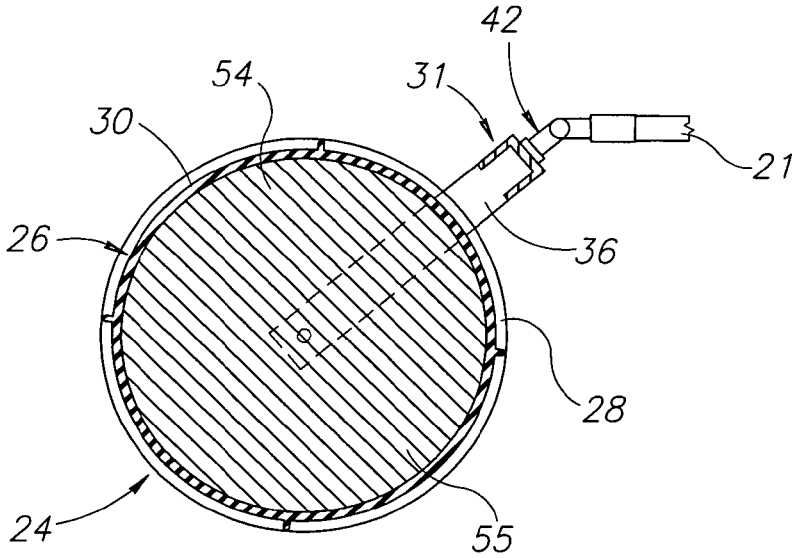
FIG. 4 shows a cross sectional view of the apparatus of FIG. 2, taken along line 4—4 of FIG. 2.

Alternately, as shown in FIG. 3B, the roller 24 can have its axle in two portions 32*a*, 32*b*. These axle portions 32*a*, 32*b* would rotatably attach the roller 24 to the support member 31, as detailed above.

These lateral members 36 are supported by a cross bar 40 of the support member 31. The lateral members 36 and cross bar 40 are typically of metal, such as aluminum, stainless steel or the like. This cross bar 40 typically attaches to the lateral members 36 by bolts, screws or other mechanical type fasteners. Additional securement may be with welds, adhesives and the like. Alternately, the support member 31 may be unitary member, formed of metal, such as aluminum, stainless steel or the like, with the lateral members 36 bent downward from the cross bar 40. A joint 42, typically pivotal, for receiving and engaging the handle 21 is typically attached to the cross bar 40, for example, by conventional fastening structures and methods.

The cross bar 40 itself is of a weight, such that a sufficient imprinting or stamping can be made in wet concrete. The cross bar 40 is also of sufficient strength such that it can support additional weight, that is placed onto it when desired. Weight holders, for example, posts 44, extend from the cross bar 40, that coupled with the surface 48 of the crossbar 40, support weights 50. These weights 50 are such that they can be added or removed by the user (as shown by the hand 51), depending on the dryness (tightness) of the concrete. These weights 50 are typically small weights, with holes in the middle, but other shapes and configurations of weights and corresponding weight holders on the cross bar 40 are also suitable.

This arrangement of weights 50 allows the apparatus 20 to be weighted adjustably, such that the concrete 22 can be imprinted uniformly, even though different portions of the concrete 22 are imprinted when the concrete 22 is at different stages of tightening (hardening). By allowing for adjustable weighting, a single apparatus 20 can be used for the entire area of concrete 22 that has been poured.

The stamp or imprint 26 defining the outer surface 28 of the roller 24 is typically in the layer of material 30. The stamp or imprint 26 is typically a pattern, such as bricks, a texture, such as a worn surface, or both (a pattern and a texture, for example, in various combinations), such as worn bricks. The layer of material 30 is typically an elastomeric or polymeric material, one such material being urethane rubber. However, other materials are also suitable, provided they are able to release from concrete, either alone or with the assistance of a release agent or coating.

The material layer 30 may be as thick as desired, provided the desired imprint or stamp 26 is contained therein. This material layer 30 is typically supported by foam 54 or other filling material, that fills the cavity 110 (and accordingly, the interior of the roller 24, defining a body 55 for the roller 24), surrounded by the material layer 30 during manufacturing of the roller 24, as shown in FIGS. 5 and 6 and detailed below.

Figure 5:
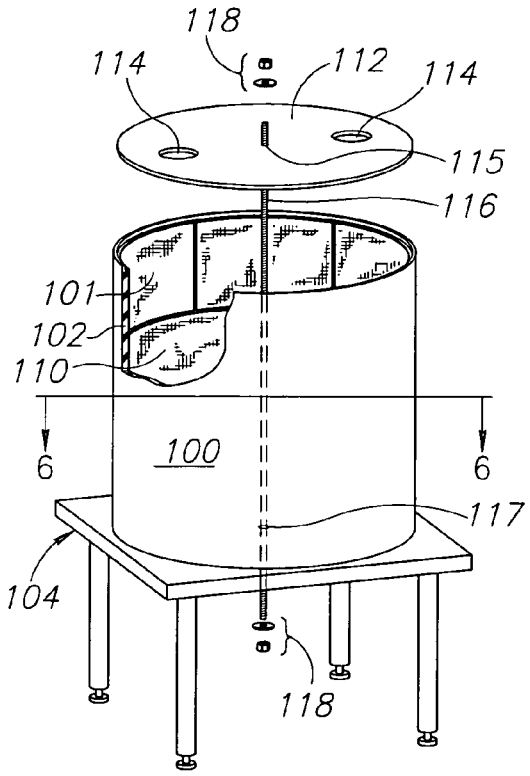
FIG. 5 shows a diagram of a mold and a manufacturing process for the apparatus of FIG. 1 with a portion broken away.
Figure 6:
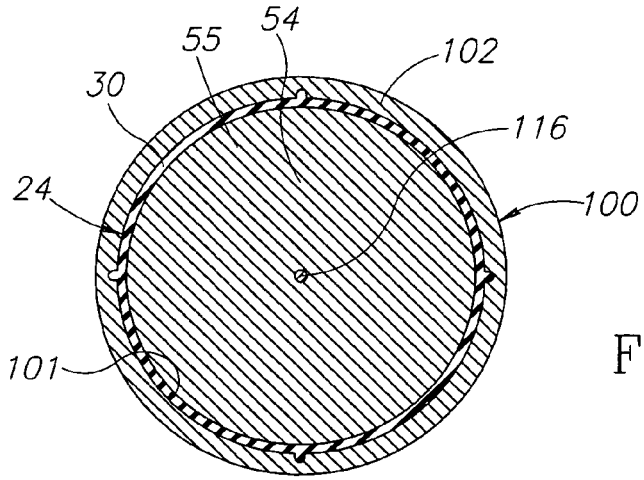
FIG. 6 is a cross sectional view of the mold shown in FIG. 5, taken along line 6—6.

Turning to FIGS. 5 and 6, the apparatus 20 can be made in a mold 100. Here, the mold 100 is, for example, a rubber split mold. This mold 100 includes a surface 101 (along its inner wall 102) corresponding to the desired imprint for the material layer 30, to create the resultant stamp 26 for the roller 24 of the apparatus 20. This mold 100 is such that the resultant imprint or stamp 26 on the material layer 30 of the roller 24 is seamless, such that the stamped concrete has a consistent and uninterrupted pattern.

A leveling stand 104 is placed below the mold 100. The surface 101 of the mold 100 is then coated with a material, typically urethane rubber or other curable material, to the desired thickness, to form the material layer 30 that retains the imprint. The material layer 30, for example, is a rubber layer, that is left to cure. This material layer 30 surrounds a cavity 110 in the mold 100. A cap 112, for fitting over the open end of the mold 100, is placed over the open end of the mold 100, for example in a friction fit. The cap 112 includes openings 114, 115. A rod 116, that becomes the axle 32 in the finished roller 24 is placed into aligned openings 115, 117 (in the leveling stand 104) and temporarily affixed in place by bolt assemblies 118 or other suitable fastening means. Once the rubber has cured, foam is added to the cavity 110 through the openings 114, where it hardens (forming the body 55 for the roller 24). The ends of the now formed roller 24 (FIGS. 1–3A and 4) can be coated with plastic or the like and smoothed over, so as to create a roller 24 with smooth ends.

The alternate roller 24 of FIG. 3B can be made in the mold 100 similarly to that described above. Here, the rod 116 can be omitted, and the opening 117 on the leveling stand 104 is closed. The roller 24 would then be made as detailed above, with axle portions 32*a*, 32*b* placed into the respective ends of the roller 24, by conventional techniques.

Figure 7:
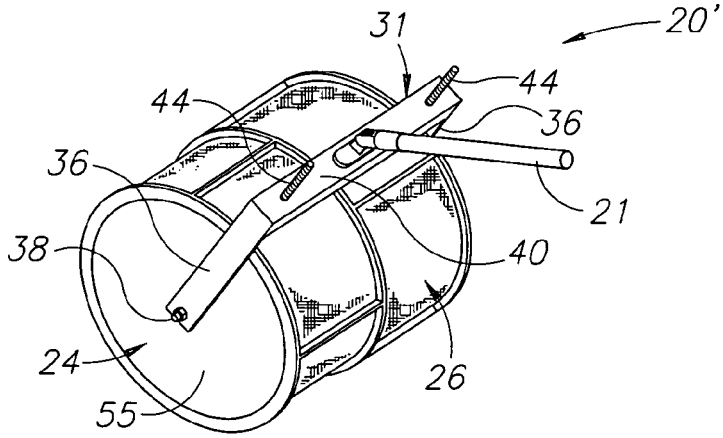
FIG. 7 shows a perspective view of a second embodiment of the apparatus of the invention.

As shown in FIG. 7, an apparatus 20', with a smaller width can be made in accordance with that detailed above. This apparatus 20' is similar in construction and manufacture to the apparatus 20, detailed above, and identical and/or similar components are numbered in accordance with those for the apparatus 20.

Figure 8:
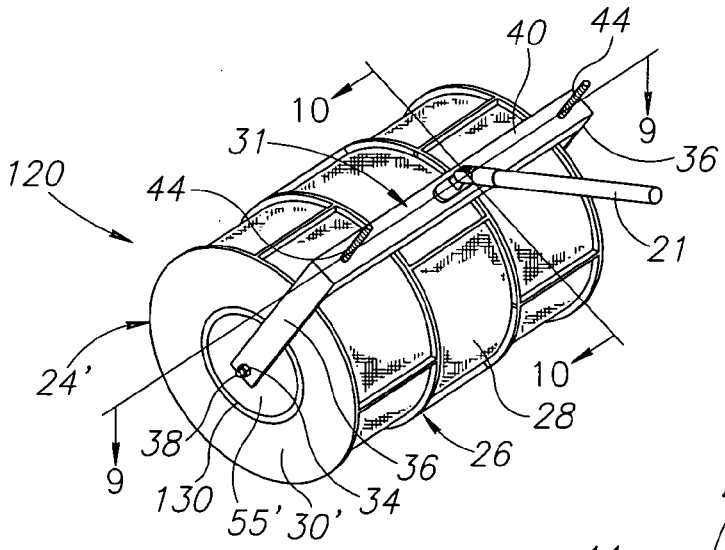
FIG. 8 shows a perspective view of a third embodiment of the apparatus of the invention.
Figure 9:
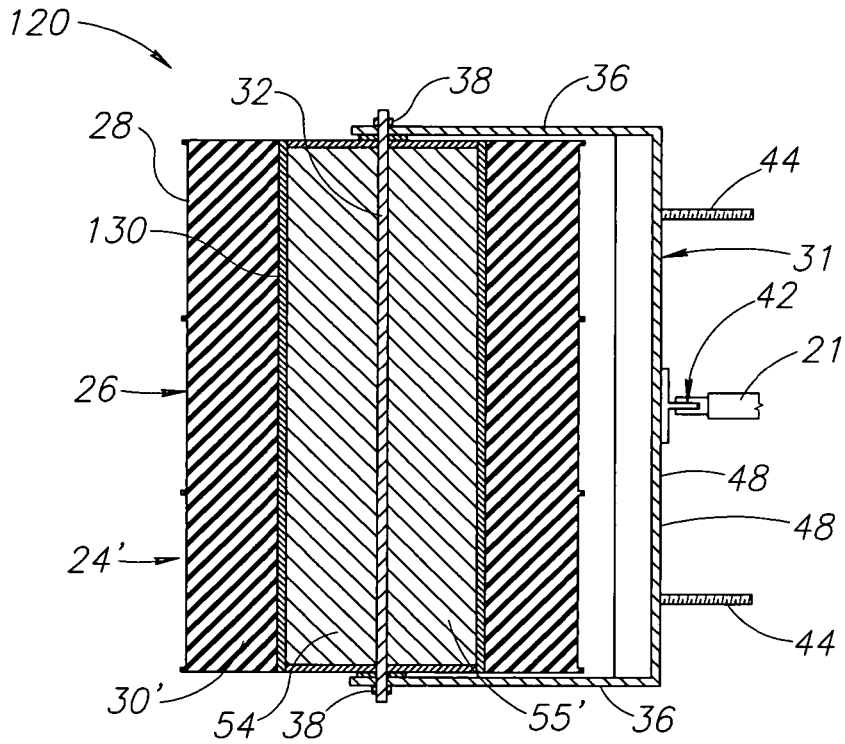
FIGS. 9 and 10 are cross sections of the apparatus of FIG. 8, taken along lines 9—9 and 10—10, respectively.
Figure 10:
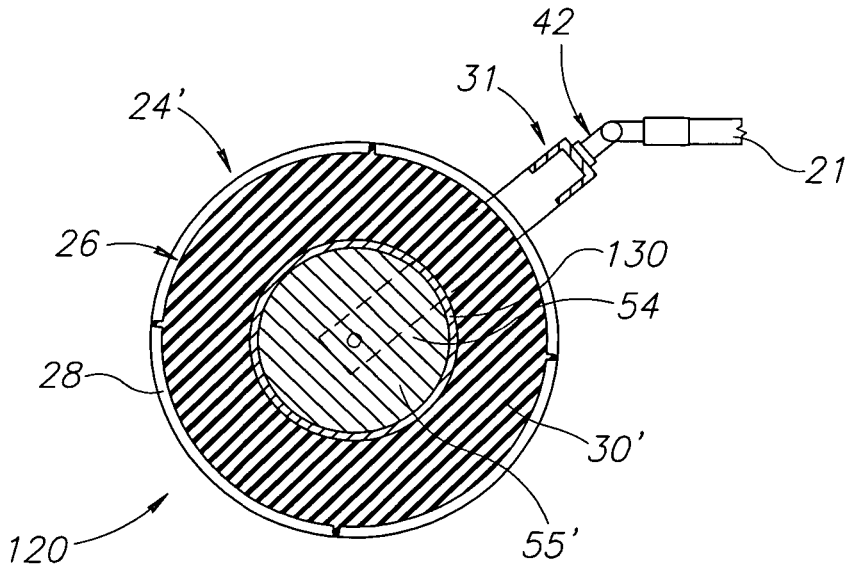

FIGS. 8–10 detail an alternate apparatus 120 having an alternate roller 24', whose material layer 30' is thicker than the material layer 30 of the apparatus 20. While components different than those from the apparatus 20 are indicated as such, identical and/or similar components are numbered in accordance with those for the apparatus 20.

Figure 11:
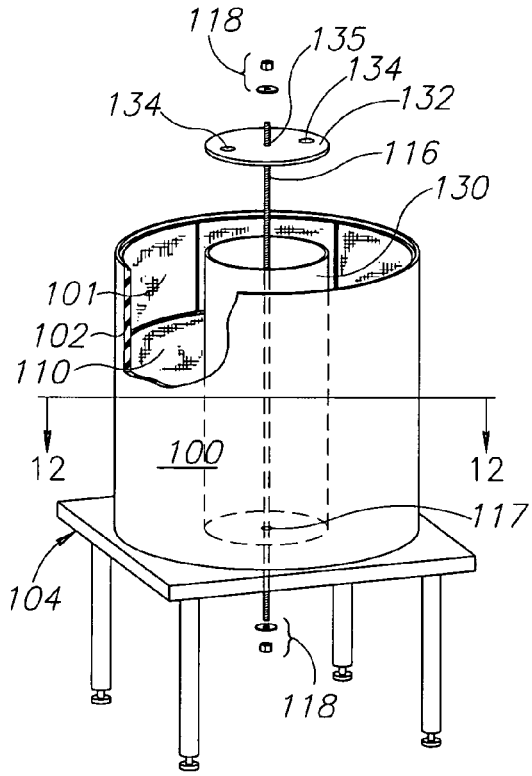
FIG. 11 shows a diagram of a mold and a manufacturing process for the apparatus of FIG. 8 with a portion broken away.
Figure 12:
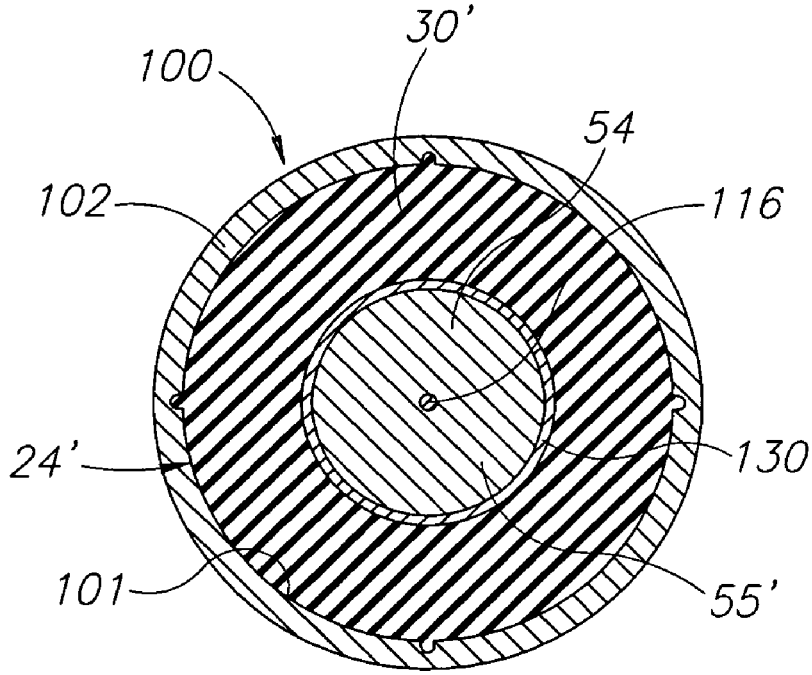
FIG. 12 is a cross sectional view of the mold shown in FIG. 11, taken along line 12—12.

Turning also to FIGS. 11 and 12, the apparatus 120 is, for example, made in the mold 100 of FIGS. 5 and 6, except, a core 130 (or core member), such as a tube or pipe, here for example, a polyvinyl chloride (PVC) pipe, is placed into the cavity of 110 of the mold 100. A cap 132, for fitting over the core 130, with openings 134 (for foam), 135 (for the rod 116, that becomes the axle 32 in the finished roller 24') is typically placed into a frictionally fitting engagement with the core 130 (PVC pipe). The rod 116 is placed into aligned openings 117 (in the leveling stand 104), 135 (in the cap 132), and temporarily affixed in place by bolt assemblies 118 or other suitable fastening means, as detailed above.

Rubber, such as urethane, or other polymeric material, typically that is curable, is then poured into the mold 100, in the space between the surface 101 and the core 130 (PVC pipe). The rubber or other polymeric material then cures, to form the material layer 30' for the roller 24' of the apparatus 20' shown in FIGS. 8–10. The core 130 can then be filled with foam 54 or the like (through the cap opening 134), to form a body 55' for the roller 24', as detailed above. The hardening of the foam 54 or other filler material locks the rod 116 in place.

Alternately, the rod 116 need not be included and the core 130 can be filled as detailed above (with the opening 117 in the leveling stand 104 plugged, as detailed above). Axle portions, such as those 32*a*, 32*b* of FIG. 3B, can be added to the drying or finished roller 24' as detailed above.

Figure 13:
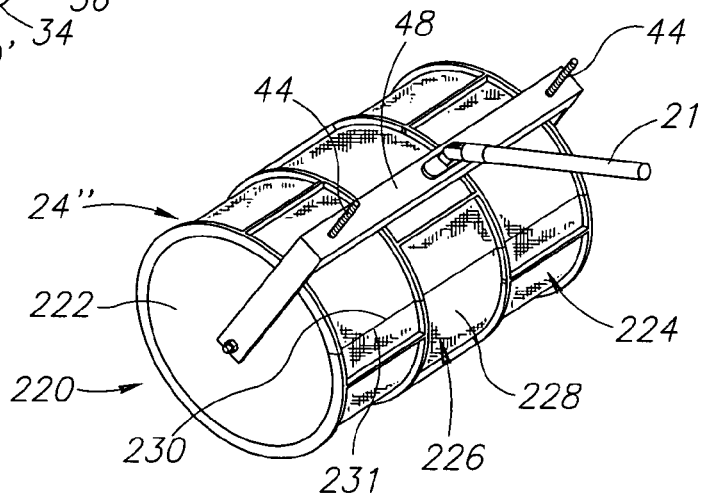
FIG. 13 is a perspective view of a fourth embodiment of the apparatus of the invention.

In an alternate apparatus 220, as shown in FIG. 13, a roller 24" can be made so as to have a smooth surface. This smooth surface can be from a core 222, typically cylindrical or drum shaped or the like, or the aforementioned core coated with a material, such as rubber, plastic or the like. A sheet 224, with the stamp 226 (of a pattern, texture, or both), defining its outer surface 228 can then be attached to a core 222, forming the roller 24". The sheet 224 should be such that its edges 230, 231 match, so as be uniform, avoiding any seams.

Turning back to FIGS. 1–3A and 4, an exemplary operation for the apparatus 20 is now described. This operation includes placing the apparatus 20 onto the poured concrete 22. The apparatus 20 is then pulled in the direction of the arrow 23*a*, such that the roller 24 rotates, leaving an imprint, corresponding to the stamp 26, in a portion of the concrete 22*a*. As the concrete 22 tightens, weights 50 can be added to the apparatus 20, in particular, placed onto the posts 24 of the crossbar 40, such that the imprint into the concrete 22 remains uniform. Weighting (as well as removal of weights 50) continues for as long as desired, depending on the tightness of the concrete 22. This pulling of the apparatus 20 continues until all of the desired concrete area has been stamped.

Figure 14:
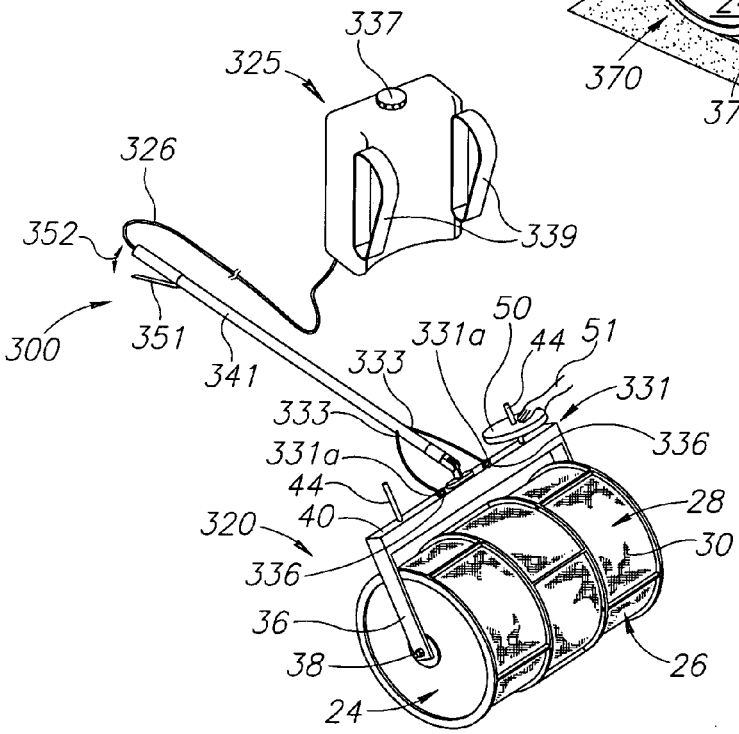
FIG. 14 is a perspective view of a fifth embodiment of the invention.
Figure 15:
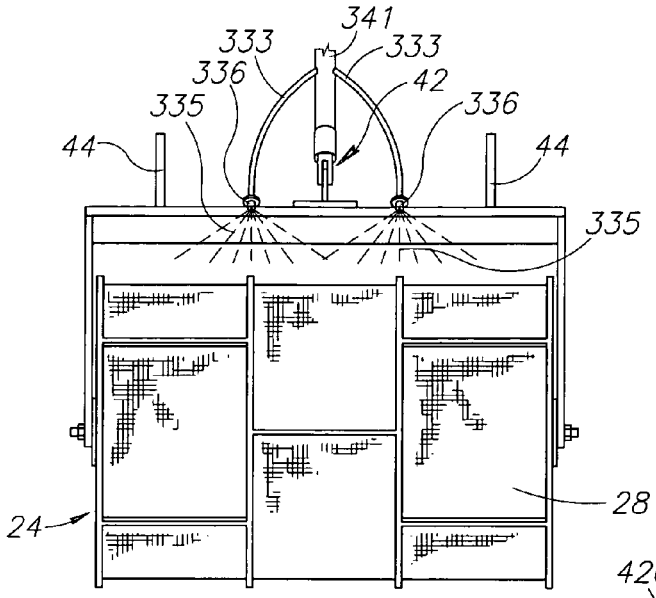
FIG. 15 is a front view of the a portion of the embodiment of FIG. 14.
Figure 16:
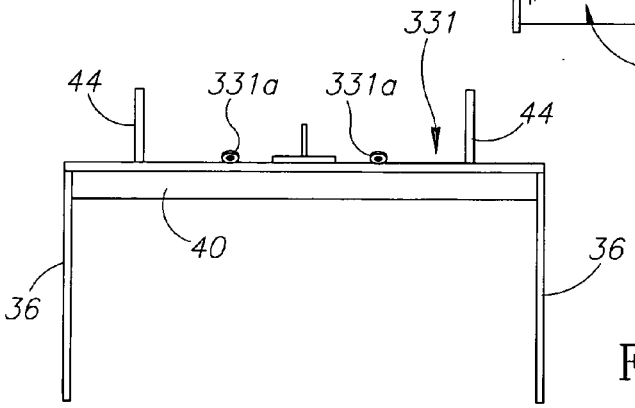
FIG. 16 is a front view of the frame of the embodiment of FIG. 14.

FIGS. 14–16 show an apparatus 300 that is the sixth embodiment of the present invention. The apparatus 300 includes a roller apparatus 320 and a tank 325 or other fluid source connected by a line 326. The roller apparatus 320 is similar to the apparatus 20 (detailed above), and is therefore numbered with the same numbers to indicate identical or like components. The support member 331 is similar to support member 31 detailed above, but also includes rings 331*a* for receiving sublines 333, that branch from the line 326. The support member 331 can also be weighted in the same manner as the support member 31, as detailed above (components are numbered identically).

The sublines 333 are constructed to be retained in the rings 331*a* to extend beyond the support member 331, so as to provide fluid, such as lubricant or release fluid (typically in a spray stream 335) to the roller 24 (on its surface 28). The sublines 333 typically terminate in spray nozzles 336 or the like, to allow for distribution of the fluid from the tank 325 over the entire roller 24.

Figure 17:
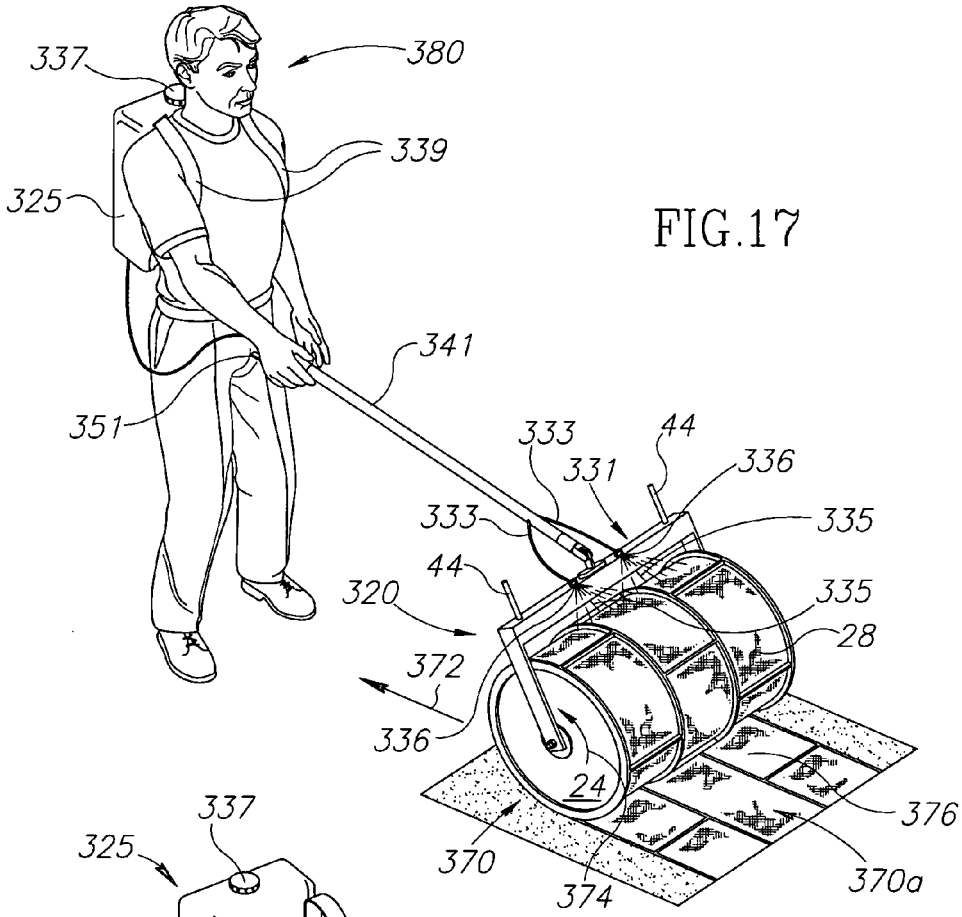
FIG. 17 is a perspective view of the embodiment of FIG. 14 shown in an exemplary operation in accordance with the present invention.

Alternately, the sublines 333 could be positioned so as to release fluid directly onto the concrete 370 (FIG. 17). The sublines 333 could also be positioned to release fluid onto both the surface 28 of the roller 24 and the concrete 370 (FIG. 17).

The tank 325 is typically a vessel, closed by a lid 337 or other similar closure. The tank 325 is typically portable, in the form of a backpack, and includes straps 339 for receiving the arms of a user 360 (FIG. 17). The tank 325 can be filled, and subsequently refilled with fluid. This fluid typically facilitates release (separation) of the roller 24 from the concrete 370 (FIG. 17), and can be fluids such as, release fluid, lubricant or the like, or combinations thereof. For example, these fluids may be water, oil, water-based compositions, oil-based compositions, petroleum-based compositions or the like, or combinations thereof. One suitable fluid is a concrete release agent, commercially available under the name Matt Crete™ Release.

The line 326 extends from the tank 325 through the handle 341 (similar to the handle 21 detailed above, except that it accommodates the line and includes openings 345 for the sub-lines 333). Alternately, a tank need not be used and the line 326 can connect to any other sprayer system.

The handle 341 also supports a grip 351, typically spring biased (movable in accordance with the arrow 352), that activates a pressuring member (not shown), When squeezed inward, toward the handle, pressure is placed on the line 325 by the pressuring member, causing fluid to be released from the sublines 333, onto the roller 24.

Turning to FIG. 17, as well as FIGS. 14–16, an exemplary operation for the apparatus 320 is now described. This operation includes a user 360 placing the tank 325 onto his shoulders and moving the roller apparatus 320 onto the poured concrete 370. The roller apparatus 320 is then pulled in the direction of the arrow 372, such that the roller 24 rotates (in the direction of the arrow 374), leaving an imprint, corresponding to the stamp 376, in a portion of the concrete 370*a*. During the rolling process, the grip 351 is squeezed as necessary, releasing fluid, described above, onto the surface 28 of the roller 24. This allows for an easy release of the roller 24 from the concrete 370.

Although not shown, should a support capable of accommodating weights be used, as the concrete 22 tightens, weights 50 can be added to the apparatus 320. Operation would be similar to that for the apparatus 20 as detailed above. Weighting (as well as removal of weights 50) continues for as long as desired, depending on the tightness of the concrete 370. This pulling of the apparatus 320 continues until all of the desired concrete area has been stamped.

Figure 18:
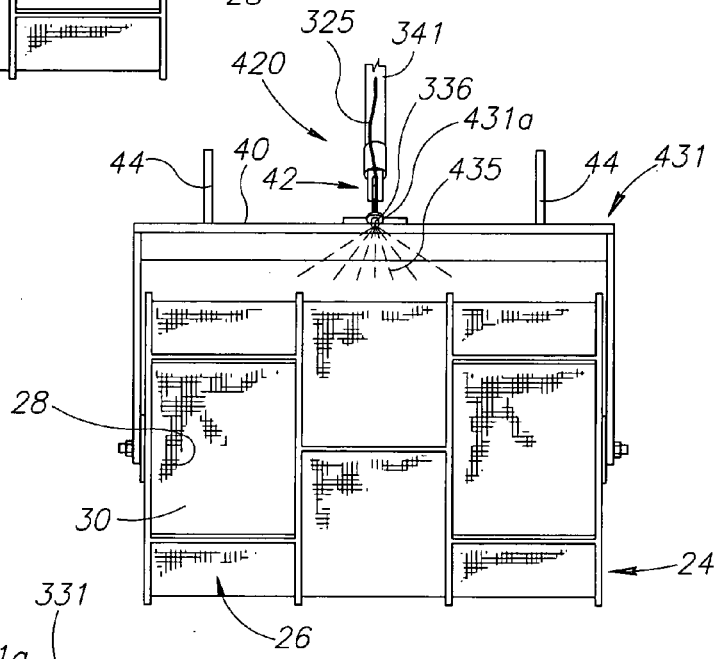
FIG. 18 is a front view of a sixth embodiment of the invention, and in particular, an alternate embodiment of the embodiment of FIGS. 14–17.

Turning now to FIG. 18, there is shown an alternate embodiment roller apparatus 420 for the roller apparatus 320. This apparatus 420 is similar in all aspects to the roller apparatus 320 except that the line 325 remains a single line that is positioned to deposit a single fluid (the fluid detailed above) stream 335 over the roller 24 (on its surface 28). The support member 431 (similar to support members 331 and 31 detailed above) includes a single ring 431*a* for holding the line 325 in a position such that fluid will be released onto the surface 28 of the roller 24. This ring 431*a* is typically centrally positioned on the crossbar 40 of the support member 431, to ensure sufficient and balanced coverage of the surface 28 of the roller 24 by the fluid.

Alternately, the line 325 can be positioned such that it releases the fluid directly onto the concrete 370 (FIG. 17). Also, the line 325 could be positioned such that it releases fluid onto the surface 28 of the roller 24 and onto the concrete 370 (FIG. 17).

Thus, there has been shown and described apparatus and processes for stamping concrete It is apparent to those skilled in the art, however, that many changes, variations, modifications, and other uses and applications for the above described embodiments are possible, and also such changes, variations, modifications, and other uses and applications which do not depart from the spirit and scope of the invention are deemed to be covered by the invention, which is limited only by the claims which follow.

What is claimed is:

1. An apparatus for stamping wet concrete comprising:

a roller, the roller including a surface defined by a stamp and oppositely disposed ends; a receiver portion for receiving the roller in a rotatable engagement, the receiver portion including a bar member extending along the roller, the bar member including oppositely disposed ends, each of the oppositely disposed ends of the bar member corresponding to a respective oppositely disposed end of the roller, and, each of the oppositely disposed ends of the bar member including at least one retainer, each of the at least one retainers for holding separate sets of weights, for weighting the roller at the oppositely disposed ends of the roller, in accordance with the tightness of the wet concrete being worked; and, a fluid transport system, the system including at least one conduit extending from a fluid source and received by the bar member for providing fluid to the roller along the surface, wherein the at least one conduit includes at least one subline branching from the conduit.

2. The apparatus of claim 1, wherein the at least one subline branching from the conduit is received by the bar member.

3. The apparatus of claim 1, wherein the at least one subline includes a spray nozzle.

4. The apparatus of claim 3, wherein the at least one subline includes two sublines.

5. The apparatus of claim 1, wherein the fluid transport system includes a fluid source in communication with the at least one conduit.

6. The apparatus of claim 5, wherein the fluid source includes a portable tank.

7. The apparatus of claim 5, wherein the fluid transport system includes an activatable mechanism for discharging fluid from the at least one conduit, the activatable mechanism in communication with the at least one conduit.

8. The apparatus of claim 1, wherein the stamp includes a pattern.

9. The apparatus of claim 1, wherein the stamp includes a texture.

10. The apparatus of claim 1, wherein the stamp includes a pattern and a texture.

11. The apparatus of claim 1, wherein the receiver portion includes:

oppositely disposed lateral members; and, a cross bar defining the bar member, the cross bar, in communication with the lateral members.

12. The apparatus of claim 11, wherein the at least one retainer at each of the oppositely disposed ends of the cross bar is substantially perpendicular to the cross bar and includes one holder.

13. The apparatus of claim 1, additionally comprising: a handle in communication with the receiver portion, the handle defining a housing for the at least one conduit.

14. The apparatus of claim 1, wherein the stamp includes a layer of material.

15. The apparatus of claim 14, wherein the material includes urethane rubber.

16. An apparatus for stamping wet concrete comprising:

a roller including oppositely disposed ends, the roller including a surface defined by a stamp; a receiver portion for receiving the roller in a rotatable engagement, the receiver portion including oppositely disposed ends corresponding to the oppositely disposed ends of the roller, each of the oppositely disposed ends of the receiver portion including at least one retainer, the at least one retainer at one of the oppositely disposed ends of the receiver portion defining at least one first retainer, and the at least one retainer at the other oppositely disposed end of the receiver portion defining at least one second retainer, the at least one first retainer and the at least one second retainer for holding separate sets of weights for weighting the roller at the oppositely disposed ends, in accordance with the tightness of the wet concrete being worked;

a handle; and, a fluid transport system, the system including at least one conduit extending from a fluid source, through the handle, and at least to the receiver portion.

17. The apparatus of claim 16, wherein the at least one conduit includes at least one subline branching from the conduit and extending at least to the receiver portion for providing fluid to the roller along the surface.

18. The apparatus of claim 17, wherein the at least one subline includes a spray nozzle.

19. The apparatus of claim 18, wherein the at least one subline includes two sublines.

20. The apparatus of claim 16, wherein the fluid transport system includes a fluid source in communication with the at least one conduit.

21. The apparatus of claim 20, wherein the fluid source includes a portable tank.

22. The apparatus of claim 20, wherein the fluid transport system includes an activatable mechanism for discharging fluid from the at least one conduit, the activatable mechanism comprising a spring biased grip that is located on the handle and is in communication with the at least one conduit.

23. The apparatus of claim 16, wherein the stamp includes a pattern.

24. The apparatus of claim 16, wherein the stamp includes a texture.

25. The apparatus of claim 16, wherein the stamp includes a pattern and a texture.

26. The apparatus of claim 16, wherein the handle is in communication with the receiver portion and defines a housing for the at least one conduit.

27. The apparatus of claim 16, wherein the stamp includes a layer of material.

28. The apparatus of claim 27, wherein the material includes urethane rubber.

29. The apparatus of claim 16, additionally comprising: weights for weighting the roller, at least one of the weights upon placement in the at least one first retainer at one oppositely disposed end of the receiver portion defining one separate set of weights, and at least one of the weights upon placement into the at least one second retainer at the other oppositely disposed end of the receiver portion defining another separate set of weights.

30. The apparatus of claim 29, wherein the weights for weighting the roller include removable weights.

31. The apparatus of claim 29, wherein the receiver portion includes:

oppositely disposed lateral members; and, a cross bar, the cross bar in communication with the lateral members.

32. The apparatus of claim 31, wherein the cross bar includes oppositely disposed ends corresponding to the oppositely disposed ends of the receiver portion, one of the oppositely disposed ends including the at least one first retainer and the other of the oppositely disposed ends including the at one second retainer.

33. The apparatus of claim 32, wherein each of the at least one first and second retainers for holding weights at each of the oppositely disposed ends of the cross bar includes at least one post which is substantially perpendicular to the cross bar.

34. The apparatus of claim 1, additionally comprising: weights for weighting the roller, at least one of the weights upon placement in the at least one retainer at one oppositely disposed end of the bar member defining one separate set of weights, and at least one of the weights upon placement into the at least one retainer at the other oppositely disposed end of the bar member defining another separate set of weights.

35. A method for stamping wet concrete comprising:

providing a stamping apparatus comprising:

a roller, the roller including a surface defined by a stamp;

a receiver portion for receiving the roller in a rotatable engagement, the receiver portion including oppositely disposed ends, and at least one retainer at each of the oppositely disposed ends for holding separate sets of weights, each set of at least one weight;

a handle; and, a fluid transport system, the system including at least one conduit extending from a fluid source, through the handle, and at least to the receiver portion, weighting the receiver portion at least at one of the oppositely disposed ends in accordance with the tightness of the wet concrete being worked by adding at least one weight to at least one retainer;

moving the apparatus over the wet concrete being worked for stamping the concrete in accordance with the stamp; and, activating the fluid transport system for releasing fluid onto the surface of the roller for releasing the roller from the concrete.

36. The apparatus of claim 34, wherein the weights for weighting the roller include removable weights.

37. The method of claim 35, additionally comprising:

taking at least one weight off of the at least one retainer.

38. A method for stamping wet concrete comprising:

providing a stamping apparatus comprising:

a roller, the roller including a surface defined by a stamp;

a receiver portion including oppositely disposed ends corresponding to the ends of the roller, the receiver portion at the oppositely disposed ends for receiving the roller in a rotatable engagement, the oppositely disposed ends of the receiver portion each including at least one retainer for holding separate sets of weights, for weighting the roller at the ends of the roller;

a handle; and, a fluid transport system, the system including at least one conduit extending from a fluid source, through the handle, and at least to the receiver portion, weighting the receiver portion at least at one of the oppositely disposed ends by adding at least one weight to the at least one retainer at the at least one oppositely disposed end of the receiver portion, to weight at least one of the ends of the roller in accordance with the tightness of the wet concrete being worked;

moving the apparatus over the wet concrete being worked for stamping the wet concrete in accordance with the imprint defined by the stamp; and, activating the fluid transport system for releasing fluid onto the surface of the roller for releasing the roller from the concrete.

39. The method of claim 38, wherein the weighting the receiver portion includes removing weight from at least one of the oppositely disposed ends of the receiver portion.

40. The method of claim 38, wherein the weighting the receiver portion includes not removing weight and not adding weight to both of the oppositely disposed ends of the receiver portion.

41. A method for stamping wet concrete comprising:

providing a stamping apparatus comprising:

a roller, the roller including a surface defined by a stamp;

a receiver portion including oppositely disposed ends corresponding to the ends of the roller, the receiver portion at the oppositely disposed ends for receiving the roller in a rotatable engagement, the oppositely disposed ends of the receiver portion each including at least one retainer for holding separate sets of weights of at least one weight each, for weighting the roller at the ends of the roller;

a handle; and, a fluid transport system, the system including at least one conduit extending from a fluid source, through the handle, and at least to the receiver portion, weighting the receiver portion at least at one of the oppositely disposed ends by adding at least one weight to the at least one retainer at the at least one oppositely disposed end of the receiver portion, to weight at least one of the ends of the roller in accordance with the tightness of the wet concrete being worked;

moving the apparatus over the wet concrete being worked for stamping the wet concrete in accordance with the imprint defined by the stamp; and, activating the fluid transport system for releasing fluid onto at least the concrete proximate to the roller, allowing for release of the roller from the concrete.

42. The method of claim 41, additionally comprising:

removing at least one weight from at least one retainer.

43. An apparatus for stamping wet concrete comprising:

a roller including oppositely disposed ends, the roller including a surface defined by a stamp; a receiver portion for receiving the roller in a rotatable engagement, the receiver portion including a member including oppositely disposed ends corresponding to the oppositely disposed ends of the roller, each of the oppositely disposed ends of the member of the receiver portion including holder mechanisms for holding separate sets of weighted members of at least one weighted member each, for weighting the roller along the ends of the receiver portion in accordance with the tightness of the wet concrete being worked; and, a fluid transport system, the system including at least one conduit extending from a fluid source and received by the member for providing fluid to the roller along the surface, wherein the at least one conduit includes at least one subline branching from the conduit.

44. The apparatus of claim 43, wherein the at least one subline branching from the conduit is received by the member.

45. The apparatus of claim 44, additionally comprising: a handle in communication with the receiver portion, the handle defining a housing for the at least one conduit.

46. The apparatus of claim 43, wherein the at least one subline includes a spray nozzle.

47. The apparatus of claim 46, wherein the at least one subline includes two sublines.

48. The apparatus of claim 43, wherein the fluid transport system includes a fluid source in communication with the at least one conduit.

49. The apparatus of claim 48, wherein the fluid source includes a portable tank.

50. The apparatus of claim 48, wherein the fluid transport system includes an activatable mechanism for discharging fluid from the at least one conduit, the activatable mechanism comprising a spring biased grip that is located on the handle and is in communication with the at least one conduit.

51. The apparatus of claim 43, wherein the stamp includes a pattern.

52. The apparatus of claim 43, wherein the stamp includes a texture.

53. The apparatus of claim 43, wherein the stamp includes a pattern and a texture.

54. The apparatus of claim 43, wherein the member including oppositely disposed ends includes: a cross bar including oppositely disposed ends corresponding to the oppositely disposed ends of the roller, and the receiver portion additionally includes lateral members, each of the lateral members in communication with an end of the cross bar, the lateral members configured for receiving the roller in a rotational engagement.

55. The apparatus of claim 54, wherein the holder mechanisms include, at least one post at each of the oppositely disposed ends of the cross bar, wherein each post is substantially perpendicular to the cross bar and weights are stacked perpendicular to the crossbar on each post.

56. The apparatus of claim 43, wherein the stamp includes a layer of material.

57. The apparatus of claim 56, wherein the material includes urethane rubber.

58. The apparatus of claim 43, additionally comprising: at least one weighted member.

59. An apparatus for stamping wet concrete comprising:

a roller, the roller including oppositely disposed ends and a surface defined by a stamp; a receiver portion for receiving the roller in a rotatable engagement, the receiver portion including, a first end and a second end oppositely disposed with respect to each other and corresponding to the oppositely disposed ends of the roller, the first end and the second end each including at least one holder for holding separate sets of weights, each of the separate sets of weights including at least one removable weight, for weighting at least at one of the oppositely disposed ends of the roller along the receiver portion in accordance with the tightness of the concrete being worked;

a handle; and, a fluid transport system, the system including at least one conduit extending from a fluid source, through the handle, and at least to the receiver portion.

60. The apparatus of claim 59, wherein the stamp includes a pattern.

61. The apparatus of claim 59, wherein the apparatus includes a texture.

62. The apparatus of claim 59, wherein the stamp includes a pattern and a texture.

63. The apparatus of claim 59, wherein the receiver portion includes: oppositely disposed lateral members, and a cross bar, intermediate the oppositely disposed lateral members, each of the lateral members and at least a portion of the cross bar defining the first and second ends of the receiver portion, the lateral members receiving the oppositely disposed ends of the roller in a rotatable engagement.

64. The apparatus of claim 59, wherein the handle is in communication with the receiver portion.

65. The apparatus of claim 59, wherein the stamp includes a layer of material.

66. The apparatus of claim 65, wherein the material includes urethane rubber.

67. The apparatus of claim 59, wherein the at least one conduit includes at least one subline branching from the conduit and extending at least to the receiver portion for providing fluid to the roller along the surface.

68. The apparatus of claim 67, wherein the at least one subline includes a spray nozzle.

69. The apparatus of claim 68, wherein the at least one subline includes two sublines.

70. The apparatus of claim 59, wherein the fluid transport system includes a fluid source in communication with the at least one conduit.

71. The apparatus of claim 70, wherein the fluid source includes a portable tank.

72. The apparatus of claim 70, wherein the fluid transport system includes an activatable mechanism for discharging fluid from the at least one conduit, the activatable mechanism comprising a spring biased grip that is located on the handle and is in communication with the at least one conduit.

73. The apparatus of claim 59, additionally comprising: removable weights for weighting the roller, at least one of the removable weights upon placement into the at least one holder at the first end of the receiver portion defining one separate set of weights, and at least one of the weights upon placement into the at least one holder at the second end of the receiver portion defining another separate set of weights.

74. An apparatus for stamping wet concrete comprising:

a roller including oppositely disposed ends, the roller including a surface defined by a stamp;

a receiver portion for receiving the roller in a rotatable engagement, the receiver portion including oppositely disposed ends corresponding to the oppositely disposed ends of the roller, each of the oppositely disposed ends of the receiver portion including at least one holder mechanism for holding separate sets of weights, the separate sets of weights defined by weight being held individually by each of the at least one holder mechanisms, and for weighting the roller along the ends of the receiver portion in accordance with the tightness of the wet concrete being worked;

a handle and, a fluid transport system, the system including at least one conduit for providing fluid for releasing the roller from the surface over which it rides, wherein the conduit extends from a fluid source, through the handle, and at least to the receiver portion.

75. The apparatus of claim 74, additionally comprising: at least one weight for being held by either of the at least one holder mechanisms.

76. The apparatus of claim 74, wherein the at least one conduit includes at least one subline on its end, the at least one subline configured for extending at least to the receiver portion for providing fluid to the roller along the surface.

77. The apparatus of claim 76, wherein the at least one subline includes two sublines.

78. The apparatus of claim 71, wherein the fluid transport system includes a fluid source in communication with the at least one conduit.

79. The apparatus of claim 78, wherein the fluid source includes a portable tank.

80. The apparatus of claim 79, wherein the fluid transport system includes an activatable mechanism for discharging fluid from the at least one conduit, the activatable mechanism comprising a spring biased grip that is located on the handle and is in communication with the at least one conduit.

81. The apparatus of claim 74, wherein the stamp includes a pattern.

82. The apparatus of claim 74, wherein the stamp includes a texture.

83. The apparatus of claim 74, wherein the stamp includes a pattern and a texture.

84. The apparatus of claim 74, wherein each of the at least one holder mechanisms include, at least one post extending from the receiver portion and substantially perpendicular to the receiver portion.

* * * * *